US011642756B2

(12) United States Patent
Martinez et al.

(10) Patent No.: US 11,642,756 B2
(45) Date of Patent: May 9, 2023

(54) ABRASIVE ARTICLE WITH ANIONIC WATER SOLUBILIZING MATERIAL AND METHOD OF MAKING

(71) Applicant: 3M INNOVATIVE PROPERTIES COMPANY, St. Paul, MN (US)

(72) Inventors: Jaime A. Martinez, Woodbury, MN (US); Thomas J. Nelson, Woodbury, MN (US); Maria del Mar Casado Mateos, Madrid (ES); Maria del Carmen Martin Rivera, Madrid (ES); Cristobal Martin Bernia, Madrid (ES); Jon P. Nietfeld, Woodbury, MN (US); Myhanh T. Truong, Cottage Grove, MN (US); Gregory G. Mehsikomer, Maplewood, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 360 days.

(21) Appl. No.: 16/630,706

(22) PCT Filed: Jul. 6, 2018

(86) PCT No.: PCT/US2018/040992
§ 371 (c)(1),
(2) Date: Jan. 13, 2020

(87) PCT Pub. No.: WO2019/014050
PCT Pub. Date: Jan. 17, 2019

(65) Prior Publication Data

US 2021/0078138 A1 Mar. 18, 2021

Related U.S. Application Data

(60) Provisional application No. 62/532,745, filed on Jul. 14, 2017.

(51) Int. Cl.
*B24D 3/00* (2006.01)
*B24D 11/00* (2006.01)
*B24D 3/20* (2006.01)

(52) U.S. Cl.
CPC ..... *B24D 3/002* (2013.01); *B24D 3/20* (2013.01); *B24D 11/001* (2013.01)

(58) Field of Classification Search
CPC ..... B24D 3/002; B24D 3/20; B24D 11/001
See application file for complete search history.

(56) References Cited

U.S. PATENT DOCUMENTS

| | | | | | |
|---|---|---|---|---|---|
| 5,681,612 | A * | 10/1997 | Benedict | B24D 3/28 | 427/202 |
| 5,928,070 | A * | 7/1999 | Lux | B24D 11/005 | 451/526 |
| 6,599,977 | B1 * | 7/2003 | Hesselmans | C09D 175/04 | 428/319.3 |
| 2002/0142705 | A1 | 10/2002 | Sugiura | | |
| 2006/0148970 | A1 * | 7/2006 | Kuba | C09D 175/04 | 524/507 |
| 2007/0066186 | A1 * | 3/2007 | Annen | B24D 11/001 | 451/41 |
| 2008/0207833 | A1 | 8/2008 | Bear | | |
| 2008/0233850 | A1 * | 9/2008 | Woo | B24D 11/02 | 451/526 |
| 2009/0142979 | A1 * | 6/2009 | Farmer | B32B 5/26 | 427/430.1 |
| 2012/0214938 | A1 * | 8/2012 | Mannari | C08G 18/12 | 528/80 |

FOREIGN PATENT DOCUMENTS

| | | | | |
|---|---|---|---|---|
| CN | 103602296 | * 2/2014 | C09J 175/04 | |
| DE | 3028495 | 2/1982 | | |
| WO | WO 2010-053729 | 5/2010 | | |
| WO | WO 2012-141905 | 10/2012 | | |
| WO | WO 2015/188067 | 12/2015 | | |
| WO | WO 2016/167967 | * 10/2020 | B24D 11/00 | |

OTHER PUBLICATIONS

International Search Report for PCT International Application No. PCT/US2018/040992, dated Oct. 15, 2018, 4 pages.

* cited by examiner

*Primary Examiner* — Pegah Parvini
(74) *Attorney, Agent, or Firm* — Katherine M. Scholz

(57) ABSTRACT

An abrasive article includes backing material, binder comprising an anionic water solubilizing material provided on at least a portion of the backing material and abrasive particles provided on at least a portion of the backing material. A method of making such an abrasive article comprises the steps of providing a backing material, applying a first binder containing an anionic water solubilizing material to the backing material, and applying abrasive particles to the backing material.

9 Claims, No Drawings

ABRASIVE ARTICLE WITH ANIONIC WATER SOLUBILIZING MATERIAL AND METHOD OF MAKING

CROSS REFERENCE TO RELATED APPLICATIONS

This application is a national stage filing under 35 U.S.C. 371 of PCT/US2018/040992, filed Jul. 6, 2018, which claims the benefit of U.S. Provisional Application No. 62/532,745, filed Jul. 14, 2017, the disclosure of which is incorporated by reference in its/their entirety herein.

BACKGROUND

The present invention relates generally to abrasives and, more particularly, to an abrasive article produced with more environmentally friendly materials.

Abrasive articles are useful for abrading, finishing and grinding a wide variety of materials and surfaces in the manufacturing of goods. As such, there continues to be a need for improving the cost, performance and manufacture of abrasive articles.

SUMMARY

The present disclosure provides an abrasive article comprising a backing material, a binder on at least a portion of the backing material, and abrasive particles provided on at least a portion of the backing material. In one embodiment, the binder comprises an anionic water solubilizing material. In a more specific embodiment, the anionic water solubilizing material comprises dimethylolpropionic acid (DMPA).

The present disclosure also provides an intermediate abrasive article preform comprising a backing material, and a pre-bond resin comprising an aqueous polyurethane dispersion containing an anionic water solubilizing material on at least a portion of the backing material.

In a specific embodiment, the present disclosure provides a nonwoven abrasive pad comprising an open lofty fibrous nonwoven web comprising at least 55% synthetic fibers, a polyurethane binder containing DMPA distributed generally uniformly throughout the nonwoven web, thereby serving to bond the fibers of the nonwoven web together, a secondary binder provided on an outer surface region of the nonwoven web, and abrasive particles forming an abrasive surface of the hand pad. In a specific aspect, the nonwoven abrasive pad has a bulk density of from about 0.04 g/cm$^3$ to 0.12 g/cm$^3$.

The present disclosure also provides a method of making an abrasive article comprising the steps of providing a backing material, applying a first binder containing an anionic water solubilizing material to the backing material, and applying abrasive particles to the backing material.

In this application:

"synthetic fibers" refers to fibers produced from synthetic polymers,

"natural fibers" refers to fibers derived directly from plants, and

"dispersion" refers to a mixture in which particles having a first composition are dispersed in a continuous phase of a second composition.

Advantages of certain embodiments described herein include that the abrasive article can be produced without the use of organic solvents, and that lofty nonwoven abrasive articles, such as hand pads and floor pads, can be produced using conventional coating techniques while maintaining desirable properties of the abrasive article such as thickness, flexibility and bulk density.

DETAILED DESCRIPTION

Abrasive articles according to the present disclosure generally include a backing material, a binder on at least a portion of the backing material, and abrasive particles secured to at least a portion of the backing material. The abrasive article may take various forms including, for example, coated abrasives (i.e. an abrasive such as a sheet, disc or belt, wherein abrasive particles are secured to a surface of a flexible substrate) or nonwoven abrasive articles, such as a lofty nonwoven abrasive article in the form of a hand pad or floor pad. The backing material, binder and abrasive particles used in the various embodiments are described in more detail below.

Backing Material

Suitable backing materials for the abrasive articles described herein include those typically used in coated and nonwoven abrasive articles including paper, polymeric films (for example, polyolefin films such as polypropylene including biaxially oriented polypropylene) polyester films, polyamide films, cellulose ester films, metal foils, wire or fabric mesh materials, open or closed cell foams (for example, natural, cellulosic or polyurethane foams), nonwoven fiber webs, cloth (for example, woven, knitted or stitch bonded cloth made from fibers or yarns comprising polyester, nylon, silk, cotton, and/or rayon), vulcanized fiber, nonwoven fabrics, and multi-layer combinations thereof.

In one embodiment, the nonwoven backing material is an open lofty fibrous nonwoven web comprising an entangled web of fibers. The fibers may comprise continuous fibers, staple fibers, and combinations thereof. The fibers may comprise synthetic fibers, natural fibers and combinations thereof. Suitable synthetic fibers include, for example, polymeric fibers, such as nylon, polyamide, polyester, polyethylene, polypropylene, polylactic acid, and melamine, and suitable natural fibers include plant-based fibers such as agave, coco, hemp, curaua, and bamboo.

In some embodiments, the open lofty fibrous nonwoven web may comprise up to about 10%, 20%, 30% or 40% natural fibers. In some embodiments, the open lofty fibrous nonwoven web may comprise at least about 50%, 60%, 70%, 80% or 90% synthetic fibers. The nonwoven web may include fibers having a denier of at least about 3, 10 or 15 and no greater than about 75, 100, 200 or 500. In addition, the nonwoven web may include different ratios of fibers having different deniers. In addition, the nonwoven web may comprise crimped fibers having a crimp index of about 2 to about 10 crimps per centimeter (cm).

The open lofty nonwoven web may also comprise heat sensitive fibers. In some embodiments, the nonwoven web may comprise no greater than about 1%, 2%, or 4% heat sensitive fibers. Heat sensitive fibers are secondary fibers with a lower melting or softening temperature than the primary fibers. Having a lower melting temperature allows the heat sensitive fibers to be heated to a temperature below that at which the primary fibers are degraded or start to melt. Upon softening, bonds form at the contact points between the heat sensitive fibers and contiguous fibers. Suitable heat sensitive fibers are well known and include both monocomponent or multi-component fibers.

In some embodiments, the open lofty nonwoven web may have a basis weight of at least about 50 g/m$^2$ or at least about 100 g/m$^2$, and a basis weight of no greater than about 300

$g/m^2$ or no greater than about 500 $g/m^2$. In addition, the nonwoven web may have a bulk density of less than about 0.1, 0.07, 0.05 or 0.02 $g/cm^3$. In a specific embodiment, the nonwoven web has a bulk density of from about 0.017 $g/cm^3$ to about 0.05 $g/cm^3$.

Binder

The abrasive article may include first and second binders. The first binder may be a make coat for bonding the abrasive particles to the backing material, or the first binder may be a pre-bond resin that serves to bond the loose fibers of an unbonded nonwoven web, thereby forming a reinforced web that can be used in the formation of nonwoven abrasive articles.

In accordance with a characterizing aspect of the abrasive article, the first binder comprises an anionic water solubilizing material provided on at least a portion of the backing material. In a more specific aspect, the anionic water solubilizing material comprises dimethylolpropionic acid (DMPA). The first binder may comprise a polymeric resin. Suitable polymeric resins include polyurethanes, including aliphatic and aromatic polyurethanes. More specifically, the polyurethane resin may comprise a polycarbonate polyurethane, a polyester polyurethane or polyether polyurethane. The polyurethane may comprise a homopolymer or a copolymer. Suitable homopolymers may comprise an acrylate or polyvinyl chloride (PVC). Suitable copolymers may comprise an acrylate copolymer, and suitable acrylate copolymers may comprise an acrylate-styrene copolymer. In some embodiments, the copolymer may comprise a styrene-butadiene rubber (SBR), or ethylene-vinyl acetate (EVA).

In a more specific aspect, the first binder may be formed using an aqueous or waterborne polyurethane dispersion (PUD). Aqueous polyurethane dispersions (PUDs) have recently emerged as alternatives to solvent-based counterparts for various applications due to increasing health and environmental awareness. Until now, however, such aqueous PUDs have not been found to be particularly suitable for abrasive applications, such as nonwoven abrasive applications. Surprisingly, it has now been found that certain aqueous PUDs have desirable characteristics that allow them to be used in the production of open lofty fibrous nonwoven abrasive articles. More specifically, during the formation of lofty nonwoven abrasive articles, the nonwoven web may be compressed. It has been discovered that certain nonwoven web constructions—after being treated with certain aqueous PUDs and compressed—will re-loft more closely to their pre-compressed thickness than others. While the behaviour is not fully understood, and there may be many factors that influence how a treated lofty fibrous nonwoven web will re-loft after being compressed, it has been found that certain aqueous PUDs allow the treated nonwoven web to rebound more fully than others. That is, it has been found that when a lofty fibrous nonwoven web is coated (or saturated) with certain aqueous PUDs and the web is compressed, upon removal of the compression force, some of the webs will rebound only slightly and will, therefore, remain in an undesirably compressed state, while other webs will return to a more open lofty state that is desirable for producing open lofty nonwoven abrasive articles such as hand pads and floor pads.

In one embodiment, the aqueous PUD used to form the first binder contains less than about 20%, 10%, 5% or 2% organic solvent. In a specific embodiment, the aqueous PUD is substantially free of organic solvent. In some embodiments, it has been found that the aqueous PUD comprises at least about 7%, 15% or 20% solids, and no greater than about 50% or 60% solids. The aqueous PUD may comprise no greater than about 80%, 85% or 93% water. In some embodiments, it has been found that the aqueous PUD forms a film having a Koenig hardness of at least about 30 and no greater than about 200 seconds when measured according to ASTM 4366-16. Further, in some embodiments, it has been found that the aqueous PUD may have a surface tension that is at least about 50% of the surface tension of water and no greater than about 300% of the surface tension of water. And in some embodiments, the aqueous PUD may have a viscosity of at least about 10 mPa s to no greater than about 600 mPa s, or at least about 70%, 80% or 90% of the viscosity of water and no greater than about 600%, 500% or 400% of the viscosity of water. In addition, in some embodiments, it has been found that the aqueous PUD comprises at least about 100, 1,000, 10,000 parts per million (ppm) of DMPA.

Aqueous PUDs that have been found to be particularly useful in the production of lofty fibrous nonwoven abrasives because they allow lofty fibrous nonwoven webs to rebound more fully after being compressed include the following:

1) Alberdingk U 6150, a solvent-free, aliphatic polycarbonate polyurethane dispersion available from Alberdingk Boley GmbH, Krefeld, Germany, having a viscosity ranging from 50-500 cps (according to ISO 1652, Brookfield RVT Spindle 1/rpm 20/factor 5), an elongation at break of about 200%, and a Koenig hardness after curing of about 65-70 s.

2) Alberdingk U 6800, an aqueous, solvent-free, colloidal, low viscosity dispersion of an aliphatic polycarbonate polyurethane without free isocyanate groups available from Alberdingk Boley GmbH, Krefeld, Germany, having a viscosity ranging from 20-200 mPas (according to ISO 2555, Brookfield RVT Spindle 1/rpm 50/factor 2), an elongation at break of about 500%, and a Koenig hardness after curing of about 45 seconds.

3) Alberdingk U 6100, an aqueous, colloidal, anionic, low viscosity dispersion of an aliphatic polyester-polyurethane without free isocyanate groups available from Alberdingk Boley GmbH, Krefeld, Germany, having a viscosity of 20-200 mPas (according to ISO 1652, Brookfield RVT Spindle 1/rpm 50 factor 2), an elongation at break of about 300%, and a Koenig hardness after curing of about 50 s.

4) Alberdingk U9800—a solvent-free aliphatic polyester polyurethane dispersion available from Alberdingk Boley GmbH, Krefeld, Germany having a viscosity of 20-200 cps (according to ISO 1652, Brookfield RVT Spindle 1/rpm 20/factor 5), and elongation at break of about 20-50%, and a Koenig hardness after curing of about 100-130 s.

5) Adiprene BL16—a liquid urethane elastomer with blocked isocyanate curing sites available from Chemtura, Middlebury, Conn.

Optional additives including rheological modifiers, anti-foaming agents, water based latex and crosslinkers may be added to the aqueous PUD. Suitable crosslinkers include, for example, polyfunctional aziridine, methoxymethylolated melamine, urea resin, carbodiimide, polyisocyanate and blocked isocyanate. Additional water may also be added to dilute the formulation of the aqueous PUD. It will be understood that the first binder may be formed using, for example, an aqueous PUD and a water-based latex.

When formed in this manner, it will be recognized that the binder itself (i.e. the cured binder formed from the aqueous PUD and the water based latex) will include polyurethane and latex resin.

As alluded to previously, the abrasive article may include a second binder. Suitable materials for the second binder include phenolic resins, polyurethane resins, polyureas, styrene-butadiene rubbers, nitrile rubbers, epoxies, acrylics, and polyisoprene. Such materials may be water soluble.

Examples of water soluble resins include modified styrene-butadiene rubbers, polyethylene glycol, polyvinylpyrrolidones, polylactic acid (PLA), polyvinylpyrrolidone/vinyl acetate copolymers, polyvinyl alcohols, carboxymethyl celluloses, hydroxypropyl cellulose starches, polyethylene oxides, polyacrylamides, polyacrylic acids, cellulose ether polymers, polyethyl oxazolines, esters of polyethylene oxide, esters of polyethylene oxide and polypropylene oxide copolymers, urethanes of polyethylene oxide, and urethanes of polyethylene oxide and polypropylene oxide copolymers In one embodiment, the second resin and the abrasive particles may be spray-coated simultaneously onto the preformed backing material, which may be, for example, a pre-bonded open lofty nonwoven web. Alternatively, the second resin and abrasive particles may be coated simultaneously as a slurry (for example, by spraying), or the second resin may be applied (for example, by spraying) by itself without the abrasive particles to the backing material to form a make coat to which dry abrasive particles may applied (for example, by drop coating or spraying) while the second resin is wet.

In a specific embodiment, the dry coating weight of the first and second binders is at least about 50 or 100 g/m$^2$, and no greater than about 200 or 300 g/m$^2$. In another specific embodiment, the wet coating weight of the first and second binders is at least about 50 or 150 g/m$^2$ and no greater than about 250 or 400 g/m$^2$.

Abrasive Particles

Suitable abrasive particles for the abrasive articles described herein include any known abrasive particles or materials useable in abrasive articles. Useful abrasive particles include, for example, fused aluminum oxide, heat treated aluminum oxide, white fused aluminum oxide, black silicon carbide, green silicon carbide, silicon oxide, magnesium oxide, titanium oxide, titanium diboride, boron carbide, tungsten carbide, titanium carbide, diamond, cubic boron nitride, garnet, fused alumina zirconia, sol gel abrasive particles, silica, iron oxide, chromia, ceria, zirconia, titania, silicates, metal carbonates (such as calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, aluminum trihydrate, graphite, metal oxides (e.g., tin oxide, calcium oxide), aluminum oxide, titanium dioxide) and metal sulfites (e.g., calcium sulfite), metal particles (e.g., tin, lead, copper), diamond (natural and synthetic), and mixtures thereof. As used herein, the term abrasive particle also encompasses single abrasive particles bonded together with, for example, a polymer, a ceramic, a metal or a glass to form abrasive agglomerates.

The abrasive particles may also be provided in specific shapes including, for example, rods, triangles, pyramids, cones, solid spheres, hollow spheres and the like. Alternatively, the abrasive particle may be randomly shaped.

In embodiments where the backing material is an open lofty nonwoven web, the abrasive particles may be distributed generally uniformly throughout the nonwoven web or be provided in a gradient wherein an outer surface region of the nonwoven web has a higher concentration of abrasive particles then the interior region of the nonwoven web. In some embodiments, the coating weight of the abrasive particles may be at least about 2, 3, or 4 grains/4×6 and no greater than about 20, 15 or 10 grains/4×6, or at least about 100 grams/square meter (gsm) to no greater than about 1000 gsm. In one embodiment, the abrasive particles have a hardness of at least about 6 on the Mohs hardness scale. In another embodiment, the abrasive particles have an average size of at least about 100, 500 or 1,000 nanometers.

In a particularly desirable embodiment, the abrasive articles may have a thickness of at least about 0.12, 0.15 or 0.2 inches, and a thickness of no greater than about 2.5, 3, 3.5, 4 or 5 inches. In another desirable embodiment, the nonwoven web has an average or gross bulk density of less than about 0.3, 0.2 or 0.15 g/cm$^3$. In a more specific embodiment, the abrasive articles have an average or gross bulk density ranging from about 0.01 g/cm$^3$ to 0.1 g/cm$^3$.

The present disclosure also provides an intermediate abrasive article preform. The intermediate abrasive article preform is produced after applying a first binder to a backing material. In one embodiment, the intermediate abrasive article preform comprises a backing material and a pre-bond resin comprising an aqueous polyurethane dispersion containing an anionic water solubilizing material provided on at least a portion of the backing material. In a more specific embodiment, the backing material is an open lofty fibrous nonwoven web, and the water solubilizing material comprises DMPA. After the intermediate abrasive article preform is produced, the pre-bond resin can be cured using, for example, heat, light or other suitable curing techniques. A finished abrasive article can then be produced by, for example, spray coating a make coat resin onto the cured preform, drop coating or electrostatically coating abrasive particles onto the wet make coat resin, and then curing the make coat resin. Alternatively, the make coat resin and abrasive particles may be applied to the cured preform simultaneously in a single step by, for example, spray coating the make coat resin and abrasive particles onto the cured preform.

In a specific embodiment, the abrasive article may comprise an open lofty fibrous nonwoven abrasive hand pad or floor pad having opposed first and second major surfaces separated by an interior region. The nonwoven abrasive pad may comprise an open lofty fibrous nonwoven web comprising nylon, polyethylene or polyester fibers, or combinations thereof. The nonwoven pad may comprise a first binder comprising a polyurethane resin containing DMPA. The first binder is distributed generally uniformly throughout the nonwoven web, thereby serving to bond the fibers together and reinforce the web. The hand pad further comprises a secondary binder that serves to bond the abrasive particles to the nonwoven web. In one embodiment, the secondary binder and abrasive particles are provided in a gradient, such that the outer region of at least one of the first and second major surfaces includes a higher concentration of abrasive particles than the interior region. In a specific embodiment, the abrasive pad has a bulk density ranging from about 0.01 g/cm$^3$ to 0.1 g/cm$^3$.

A method of making an abrasive article according the embodiments described herein includes the steps of providing a backing material, applying a first binder containing an anionic water solubilizing material to the backing material, and applying abrasive particles to the backing material. The method may comprise the additional step of applying a second binder, such as those described previously, to the backing material. The abrasive particles may be provided simultaneously with the second binder in a single coating operation, or the abrasive particles may be provided separately in a subsequent step after the second binder has been applied to the backing material. The first and second binders may be applied to the backing material using known coating techniques including, for example, brushing, spraying, dipping, roll coating and curtain coating.

In order that the invention described herein can be more fully understood, the following examples are set forth. It should be understood that these examples are for illustrative purposes only, and are not to be construed as limiting this invention in any manner.

EXAMPLES

Unless otherwise noted, all parts, percentages, ratios, etc. in the Examples and the rest of the specification are by weight.

Unless stated otherwise, all other reagents were obtained, or are available from fine chemical vendors such as Sigma-Aldrich Company, St. Louis, Mo., or may be synthesized by known methods.

Examples 1-6 and Comparative Example A

For each of Comparative Example A and Examples 1 to 6, a low density non-woven web weighing between 88 gsm (grams per square meter) and 105 gsm was formed in an air laid Rando Weber Model RFT Serial 1160 non-woven maker (obtained from Rando Machine Corporation, Macedon, N.Y., utilizing 100% 15 denier high tenacity nylon 6,6 with 40 mm staple fiber (commercially available under the trade designation "NEXYLON N250HT 17DTEX/40 MM/BR" from EMS Chemie North American Inc., Sumter, S.C.

Nonwoven abrasive articles were prepared as follows. To each example web, a pre-bond coating was applied, then a slurry coating comprising phenolic resin and mineral abrasive was applied as the final coating. For each of Examples 1 to 6, the pre-bond coat precursor formulation was 100% polymer dispersion or emulsion as provided by vendor and specified in Table 1. For comparative Example A, a solvent based pre-bond mix was used as a binder, comprising 19.5% by weight BL-16 polymer (obtained under the trade designation "ADIPRENE BL-16" available from Chemtura, Middlebury, Conn.), 75% by weight propylene glycol monomethyl ether acetate (PMA, obtained under the trade designation "PM ACETATE PROPYLENE GLYCOL" from Chem Central, Kansas City, Kans. and 5.5% by weight K450 aromatic amine curing agent (obtained under the trade designation "ROYOXY RAC-9907" from Royce International, Jericho, N.Y.

TABLE 1

| Sample | Polymer Used | Polymer Description | DMPA Presence |
|---|---|---|---|
| Comparative Example A | BL-16 | a liquid urethane elastomer with blocked isocyanate curing sites, obtained under the trade designation "ADIPRENE BL-16" available from Chemtura, Middlebury, Connecticut | No |
| Example 1 | U6150 | a solvent-free aliphatic polycarbonate polyurethane dispersion, obtained under the trade designation "U6150" from Alberdingk Boley GmbH, Krefeld, Germany | Yes |
| Example 2 | DSM R-2005 | Solvent free urethane dispersion, anionic polyurethane, stabilized with 2-dimethyl amino ethanol, from DSM Coating Resins, Wilmington, Massachusetts | Yes |
| Example 3 | U6150 | a solvent-free aliphatic polycarbonate polyurethane dispersion, obtained under the trade designation "U6150" from Alberdingk Boley GmbH, Krefeld, Germany. | Yes |
| Example 4 | Rovene 5900 | a water base styrene-butadiene rubber (SBR) emulsion, obtained under the trade designation Rovene 5900 from Mallard Creek Polymers Inc. Charlotte, North Carolina | No |
| Example 5 | Rolflex v15 | two component water base polyurethane emulsion, obtained under the trade designation Rolflex MV 15 from Lamberti Group, Gallarate, Italy | No |
| Example 6 | U9800 | a solvent-free aliphatic polyester polyurethane dispersion available from Alberdingk Boley GmbH, Krefeld, Germany | Yes |

The pre-bond coating was applied to the web via conventional spray coating or compression coating as specified in Table 2. And subsequently cured in a conventional convection oven at 140° C. for ten minutes. After the pre-bond coating, the nonwoven webs were tested for web weight and web thickness. The results are shown in Table 2.

TABLE 2

| Sample | Comparative Example A | Example 1 | Example 2 | Example 3 | Example 4 | Example 5 | Example 6 |
|---|---|---|---|---|---|---|---|
| Web coating method | compression | spray | spray | compression | compression | compression | compression |
| Web weight, nylon fiber only, gsm | 105 | 105 | 105 | 105 | 101 | 88.9 | 105 |

TABLE 2-continued

| Sample | Comparative Example A | Example 1 | Example 2 | Example 3 | Example 4 | Example 5 | Example 6 |
|---|---|---|---|---|---|---|---|
| Pre-bond coating add-on weight, gsm | 42 | 42 | 42 | 42 | 41 | 68.1 | 50 |
| Web weight after pre-bond, gsm | 147 | 147 | 147 | 147 | 142 | 157 | 155 |
| Web thickness after pre-bond, cm | 0.648 | 0.965 | 1.138 | 0.686 | 0.594 | 0.722 | 0.584 |
| density, g/cm$^3$ | 0.023 | 0.015 | 0.013 | 0.021 | 0.024 | 0.022 | 0.027 |

The nonwoven webs of these examples were completed as follows: a slurry coat (see description in next paragraph) was sprayed on one side of previously made webs. The slurry formulation was 64.0% of 280/600 aluminum Oxide mineral (obtained from Washington Mills, Hennepin, Ill.), 19.0% Laponite Premix at (Laponite Premix contains 98.5% tap water and 1.5% Laponite, obtained under the trade designation "LAPONITE RD LI MG SYN CLAY" from BYK USA, Inc. Wallingford, Conn.), 1.0% red pigment (obtained under the trade designation "RED 210 PC RPD 0210" from Sunchemical Corporation, Cincinnati, Ohio), 16.0% phenolic resin at (obtained under the trade designation "5077A PHENOLIC RESIN WATER BASED" from Arclin LLC, Roswell, Ga.). The spray conditions were as follows: 28 centimeters gun height, 620 kPa atomizing air pressure, 2.8-3.8 meter/minute line speed, metering pump 9.5-13.7 revolution per minute (rpm), spraying width 0.254 meter, gun reciprocation speed 185 stroke/minute, 65 nozzle/66 cap. The coated webs were cured in a forced-convection oven set at 177° C. for 3 minutes. Then each web was inverted and the opposite side of the web was also slurry sprayed. Samples were cured in a forced-convection oven set at 177° C. for 3 minutes to cure the coating. All samples were additionally post-cured in a forced-convection oven at 163° C. for 6 min.

The cured abrasive articles were tested for physical properties and performance as reported in Table 4.

Tensile Testing

Machine direction (md) and cross-machine direction (cd) tensile tests were performed according to the specification of ASTM D1682, Method 2C-T, and which is incorporated herein by reference. Tensile strength for each sample was recorded and shown in Table 4.

Push-Pull Wear Measurement

The test described as follows was used to measure the mechanical wear for the abrasive pad articles by rubbing of the pad that mechanically went back and forth over a diamond cloth material. Before the testing, each sample was weighed as initial weight. A 25-inch (63.5-cm)×3-inch (7.62-cm) flexible diamond cloth (obtained as "M125" from 3M Company, St. Paul, Minn.) was fastened to the center position in the tray of a push-pull wear tester. Tap water (250 milliliters) was applied evenly to the pan containing the diamond cloth stripe. The sample holder was set to be parallel to the bottom of the tester tray. The weight placed on the sample carriage was 2390±5 grams (holder plus weight). The reciprocator speed (number of stokes per minute) was set to 45 (one stroke was a pass from one end of the tester tray to the other end and back again). The pass length was 14 inches (35.6 cm). After the tester machine stopped, the sample was removed from the tester and was shaken gently to remove excess water from the samples. The sample was then placed into a forced air oven (capable of maintaining approximately 121° C.) for approximately 20 minutes until dry. After the sample was dry, the sample was re-weighed as final weight. The wear of the sample was defined as the difference between initial weight and final weight. The wear percentage was calculated as a percentage of the wear compared to initial weight.

Schieffer Cut Test:

This test provided a measure of the cut (material removed from a workpiece). A 10.16-cm diameter circular specimen was cut from the abrasive material to be tested and secured by hook and loop drive pad Dual-Lock Type 170, available from 3M Company, St. Paul, Minn. One side of the Dual-Lock Type 170 was connected to a mandrel locked into the chuck of a motor-driven spindle. The Dual-Lock Type 170 had a 10.2 cm diameter disc support with hooks (mushroom-shaped barbs) extending from the opposite surface of the disc to engage the abrasive web specimen. An acrylic disc was secured to the driven plate of a Schieffer Abrasion Tester (available from Frazier Precision Company, Gaithersburg, Md.). A circular acrylic plastic workpiece, 10.16-cm diameter by 3.17-cm thickness, available under the trade designation "POLYCAST" acrylic plastic from Seelye Plastics, Bloomington, Minn., was employed. The initial weight of each workpiece was recorded to the nearest milligram prior to mounting on the workpiece holder of the abrasion tester. A 2.26 kg load was placed on the abrasion tester weight platform and the mounted abrasive specimen was lowered onto the workpiece. The machine was set to run for 500 cycles and then automatically stop, after this the workpiece was taken out from the holder, wiped free of dust and weighed. The weight difference v.s. initial weight was defined as Initial Cut. Then the machine was set to run for 3500 cycles and then automatically stop. After that the workpiece was taken out from the machine holder and weighed, the weight difference v.s. initial weight was defined as Total Cut. The Initial Cut and Total Cut for all samples are shown in Table 4.

TABLE 4

| Physical and Performance Results | Comparative Example A | Example 1 | Example 2 | Example 3 | Example 4 | Example 5 | Example 6 |
|---|---|---|---|---|---|---|---|
| Final article weight, gsm | 357 | 390 | 405 | 348 | 357 | 349 | 367 |
| Final article thickness, cm | 0.770 | 1.011 | 1.184 | 0.762 | 0.701 | 0.722 | 0.672 |
| Final article density, g/cc | 0.046 | 0.039 | 0.034 | 0.046 | 0.051 | 0.048 | 0.055 |
| Tensile strength, Newton | 62.53 | 55.48 | 71.06 | 65.86 | 62.75 | 62.66 | 60.07 |
| Push - pull wear, % | 9.490 | 5.66 | 7.08 | 14.110 | 8.530 | 12.87 | 11.000 |
| Initial Cut, g | 0.296 | 0.305 | 0.271 | 0.299 | 0.215 | 0.263 | 0.285 |
| Total Cut, g | 1.075 | 1.225 | 1.222 | 1.092 | 0.699 | 0.94 | 1.105 |

Various modifications and alterations of this disclosure may be made by those skilled in the art without departing from the scope and spirit of this disclosure, and it should be understood that this disclosure is not to be unduly limited to the illustrative embodiments set forth herein.

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. An open lofty nonwoven abrasive article comprising:

backing material, wherein the backing material comprises fibers having a denier of about 15;

binder comprising an aqueous polyurethane dispersion (PUD) containing an anionic water solubilizing material provided throughout the backing material, wherein the polyurethane is selected from the group consisting of: a polycarbonate polyurethane, a polyester polyurethane and a polyether polyurethane; wherein the binder is formed from a mixture further comprising a water-based latex; and abrasive particles provided on at least a portion of the backing material, wherein the aqueous PUD forms a film having a Koenig hardness of at least 30 and no greater than about 200 seconds when measured according to ASTM 4366-16.

2. An abrasive article as defined in claim 1, wherein the anionic water solubilizing material comprises dimethylolpropionic acid (DMPA).

3. An abrasive article as defined in claim 1, wherein the abrasive particles are distributed throughout at least a portion of the open lofty nonwoven abrasive article.

4. An abrasive article as defined in claim 1, wherein the binder is formed of a mixture further comprising a cross-linker.

5. An abrasive article as defined in claim 1, further comprising a second binder.

6. The abrasive article as defined in claim 1, wherein the polyurethane dispersion is stabilized with 2-dimethyl amino ethanol.

7. The abrasive article as defined in claim 1, wherein the backing material comprises polyethylene fibers.

8. An open lofty nonwoven abrasive article comprising:

backing material, wherein the backing material comprises fibers having a denier of about 15;

binder conmprisinu an aqueous polyurethane dispersion (PUD) containing an anionic water solubilizing material provided throughout the backing material, wherein the polyurethane is selected rom the group consisting of: a polycarbonate polyurethane, a polyester polyurethane and a polyether polyurethane, and abrasive particles provided on at least a portion of the backing material, wherein the aqueous PUD forms a film having a Koenig hardness of at least 30 and no grater than about 200 seconds when measured according to ASTM 4366-16.

9. An open lofty nonwoven abrasive article comprising:

backing material, wherein the backing material comprises fibers having a denier of about 15;

binder comprising an aqueous polyurethane dispersion (PUD) containing an anionic water solubilizing material provided throughout the backing material, wherein the polyurethane is selected from the group consisting of: polycarbonate polyurethane, a polyester polyurethane and a polyether polyurethane, and abrasive particles provided on at least a portion of the backing material, wherein the aqueous PUD forms a film having a Koenig hardness of at least 30 and no grater than about 200 seconds when measured according to ASTM 4366-16; and wherein the polyurethane dispersion is stabilized with an amino ethanol.

* * * * *